US006637127B2

(12) United States Patent
Reede et al.

(10) Patent No.: US 6,637,127 B2
(45) Date of Patent: Oct. 28, 2003

(54) DRYER AIRFLOW SENSOR

(75) Inventors: Ivan Reede, Dollard des Ormeaux (CA); Marc Villeneuve, Dollard-des-Ormeaux (CA); David G. Allen, Toronto (CA)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/969,065

(22) Filed: Oct. 2, 2001

(65) Prior Publication Data

US 2003/0061728 A1 Apr. 3, 2003

(51) Int. Cl.[7] ..... F26B 13/10

(52) U.S. Cl. ..... 34/527; 34/546; 34/572; 34/606; 34/140

(58) Field of Search ..... 34/526, 527, 529, 34/543, 546, 547, 549, 554, 572, 595, 606, 138, 140

(56) References Cited

U.S. PATENT DOCUMENTS

| | | | | | |
|---|---|---|---|---|---|
| 2,941,308 | A | | 6/1960 | Cobb et al. | 34/48 |
| 3,286,508 | A | | 11/1966 | Spiegel | 73/38 |
| 3,484,772 | A | | 12/1969 | Niewyk et al. | 340/236 |
| 4,206,552 | A | | 6/1980 | Pomerantz et al. | 34/23 |
| 4,738,034 | A | * | 4/1988 | Muramatsu et al. | 34/524 |
| 5,097,606 | A | | 3/1992 | Harmelink et al. | 34/32 |
| 5,187,879 | A | * | 2/1993 | Holst | 34/261 |
| 5,315,765 | A | * | 5/1994 | Holst et al. | 34/260 |
| 5,321,897 | A | * | 6/1994 | Holst et al. | 34/260 |
| 5,544,428 | A | * | 8/1996 | Kuroda et al. | 34/493 |
| 5,826,128 | A | * | 10/1998 | Nishida | 396/572 |
| 5,852,881 | A | * | 12/1998 | Kuroda et al. | 34/527 |

* cited by examiner

*Primary Examiner*—Ira S. Lazarus
*Assistant Examiner*—Andrea M. Ragonese

(57) ABSTRACT

An air flow detecting system is provided for monitoring air flow in a dryer system. The dryer system has an exhaust passage through which air from a drying compartment flows. The air flow detecting system includes a detector for monitoring a rate at which air from the drying compartment travels through the exhaust passage, and a signal generator. The signal generator is responsive to the detector and generates an electrical signal for which at least one of phase, frequency, voltage, or current varies over a continuous range based on a measured flow rate.

17 Claims, 7 Drawing Sheets

DRYER AIRFLOW SENSOR

BACKGROUND OF THE INVENTION

Certain embodiments of the present invention generally relate to an air flow detecting system for a dryer system, a dryer system using an air flow detecting system, and a method of operating a dryer system based on air flow.

Conventional clothes dryers heat a compartment holding wet clothes that dry by evaporation. The effectiveness of heat in drying clothes depends on the relative humidity and temperature of the air in the compartment. As water evaporates from the clothes into the air, the air in the compartment becomes more saturated with water vapor and, consequently, less effective for drying. As a result, it is important to provide ventilation in the drying compartment to exhaust humid air and minimize the amount of water vapor in the air in the drying compartment.

Clothes dryers frequently provide an exhaust passage or duct to provide a path for air to leave a dryer. Typically, a dryer will also include a lint trap somewhere along the exhaust passage. The filling or clogging of the lint trap causes blockage in the exhaust passage and inhibits the flow of air out of the drying compartment. Often the exhaust passage includes a length of flexible hose. If the hose becomes pinched or if the hose kinks, the air flow from the dryer will be inhibited. Thus, a clogged lint trap, a kinked hose, or other situations may block the air flow out of the dryer.

The reduction of air flow through the exhaust passage may result in serious consequences. If the hot, humid air from the dryer is not exhausted, the continued addition of heat to the air from the heater may raise the temperature to dangerous levels. As the humid air is trapped in the dryer, the drying compartment air will become saturated with water vapor and no longer removes moisture from the clothes. As a result, the clothes will not dry during the drying cycle. Further, the increased temperature may damage clothes and/or dryer components. More seriously, the elevated temperature may result in the clothes catching fire which may not only destroy the clothes, but also may spread to the house or building.

One conventional approach to this problem has been to provide a temperature sensor. When the temperature in the compartment reaches a predetermined level, the temperature sensor acts to turn the dryer and/or the heater off before the temperature rises high enough to cause a fire. Temperature monitors, however, do not provide an indication of actual air flow, which is a key factor in adequate drying. For example, if air flow is blocked but the temperature does not rise high enough to turn the dryer off before the drying cycle ends, the clothes will not be dry if the trapped air was too humid to allow adequate evaporation. Conventional temperature monitoring systems do not indicate to the user that low air flow may exist, and that clothes are not being dried effectively. Further, conventional temperature monitoring systems do not provide a warning of when the dryer is operating in an ineffective but not yet dangerous situation such as before the temperature reaches a critical level but air flow is impeded. These and other drawbacks to conventional systems may result in ineffective drying, damage to clothes, damage to dryer components, and the potential for fire.

Pressure sensors have also been used in the past with dryer systems. However, these do not provide a direct measure of air flow, and can depend on external pressure. Additionally, they do not send a signal usable by a processor.

It is an object of at least certain embodiments of the present invention to overcome the above-noted and other disadvantages of conventional dryer systems.

BRIEF SUMMARY OF THE INVENTION

At least one embodiment of the present invention is provided including a dryer system having a drying compartment for holding clothing or other articles to be dried, a heater for providing heat to assist in drying the articles in the drying compartment, an exhaust passage through which air from the drying compartment is discharged, a detector for monitoring air flow through the exhaust passage, and a processor for controlling the operation of the dryer system based on an output of the detecting system. Optionally, the detecting system may include a sensor and a mechanical element. The sensor is responsive to the position of the mechanical element caused by air flow in the exhaust passage.

In accordance with at least one alternative embodiment, the dryer system includes a shaft, a fan, and a sensor. The fan is mounted on the shaft, and the fan and shaft rotate in response to air flow through the exhaust passage. The sensor, for example, a DC generator, senses rotation of the shaft.

In accordance with at least one alternative embodiment, the shaft comprises a hole, and the sensor comprises a light emitting source and a light receiver. The shaft, hole, light emitting source, and light receiver are configured so that light from the light emitting source is directed through the hole at the light receiving source, and rotation of the shaft causes the light to be received intermittently by the light receiver.

In accordance with at least one alternative embodiment, the dryer system includes a detecting system that comprises an air flow sensor that provides an intermittent signal to a processor. Each interruption of the signal varies based on the rate of air flow through the exhaust passage.

Optionally, the detecting system may generate a signal directly proportional to the rate of air flow through the exhaust passage. Optionally, the detecting system may directly monitor the air flow through the exhaust passage. Further optionally, the detector may monitor the air flow independent of atmospheric pressure.

In accordance with at least one alternative embodiment, the processor of the dryer system operates to modulate one or a plurality of operating parameters in response to the air flow rate. For example, the processor may operate to turn at least part of the dryer system off when the air flow through the exhaust opening is less than a predetermined rate. Optionally, the processor may provide a perceptible warning indication, such as a light, when the air flow through the exhaust opening is less than a first predetermined rate, and to turn at least part of the dryer system off when the air flow through the exhaust opening is less than a second predetermined rate.

At least one embodiment of the present invention is provided including an air flow detecting system for monitoring air flow in a dryer system. The dryer system has an exhaust passage through which air from a drying compartment flows. The air flow detecting system includes a detector for monitoring a rate at which air from the drying compartment travels through the exhaust passage, and a signal generator. The signal generator is responsive to the detector and generates an electrical signal for which at least one of phase, frequency, voltage, or current varies over a continuous range based on a measured flow rate.

Optionally, the electrical signal generated may be directly proportional to the rate of air flow. Optionally, the signal generator may provide an intermittent signal, where each interruption of the signal varies based on the rate of air flow.

At least one embodiment of the present invention provides a method of operating a dryer system having a heater and an exhaust passage through which air from a drying compartment flows. The method comprises the steps of detecting a flow rate, generating an electrical signal based on the detected flow rate, and controlling the operation of the dryer system responsive to the electrical signal. At least one of the phase, frequency, voltage, or current of the electrical signal varies based on the detected flow rate.

In accordance with at least one alternative embodiment, the method includes the steps of converting the air flow rate to a mechanical position and converting the mechanical position to an electrical signal. Alternatively, and in accordance with at least one alternative embodiment, the method includes the steps of converting the air flow rate to a mechanical motion and converting the mechanical motion to an electrical signal. Optionally, the method may comprise the steps of providing a light source, interrupting the light source at a phase or frequency corresponding to the air flow rate, and converting the interruption of the light to an electrical signal.

In accordance with at least one alternative embodiment, the method of operating a dryer system also includes comparing the detected flow rate to a predetermined rate, and interrupting the operation of at least a part of the dryer system if the detected flow rate is less than the predetermined rate. Optionally, the method may comprise comparing the detected flow rate to first and second predetermined rates, providing a warning signal if the detected flow rate is less than the first predetermined rate, and interrupting the operation of at least a part of said dryer system if the detected flow rate is less than the second predetermined rate.

Figure 1:
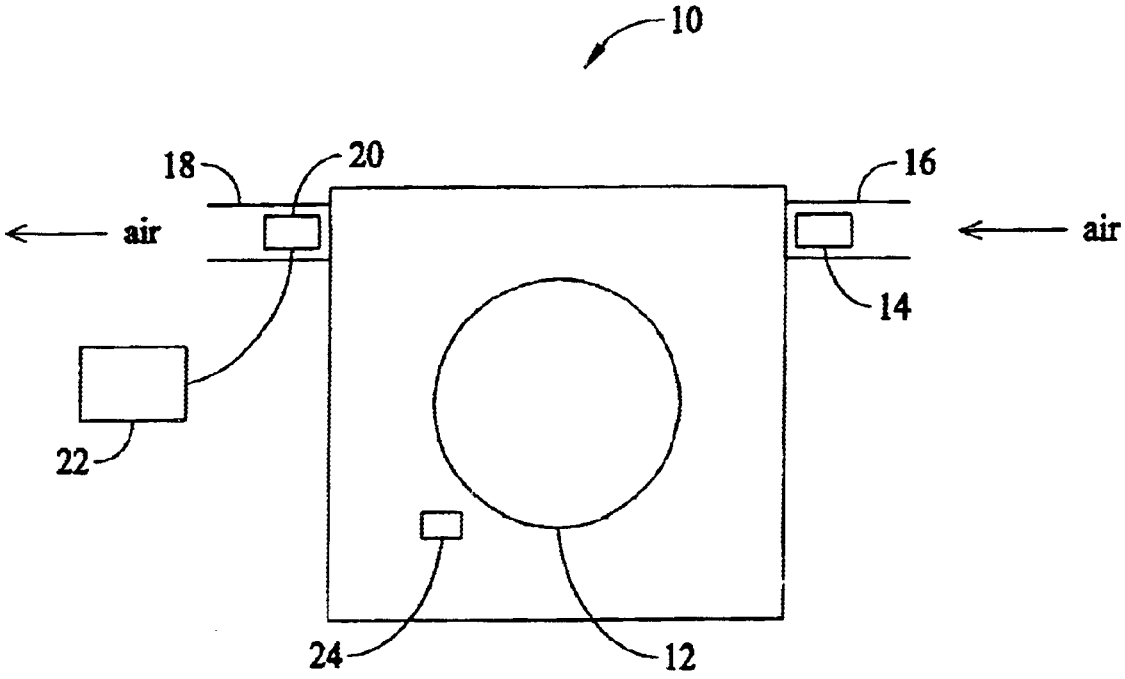
FIG. 1 illustrates the general layout of a dryer system formed in accordance with an embodiment of the present invention.

The foregoing summary, as well as the following detailed description of the preferred embodiments of the present invention, will be better understood when read in conjunction with the appended drawings. For the purpose of illustrating the invention, there is shown in the drawings, embodiments which are presently preferred. It should be understood, however, that the present invention is not limited to the precise arrangements and instrumentality shown in the attached drawings.

DETAILED DESCRIPTION OF THE INVENTION

FIG. 1 illustrates the general layout of a dryer system 10. The dryer system 10 comprises a drying compartment 12, a heater 14, an air inlet 16, an air exhaust passage 18, an air flow detecting apparatus 20, and a control processor 22. A fan and motor (not shown) act to circulate air into the dryer system 10 via the inlet 16 and out of the dryer system 10 via the exhaust passage 18. The fan and motor are preferably located proximal to the exhaust passage 18. The heater 14 is located proximal to the inlet 16 and acts to warm air as it enters the drying compartment 12. Clothing or other articles to be dried are held in the drying compartment 12. Preferably, the drying compartment 12 is a drum that is turned by a motor (not shown) while the clothes are being dried. This turning tumbles the clothes and helps to provide uniform drying. The drum sensor 24 detects whether or not the drum is rotating and optionally may detect the rate of drum rotation.

As the clothes dry, moisture from the clothes is absorbed by the air which was warmed by the heater 14 and has entered the drying compartment 12 via the inlet 16. New, dry, warm air continuously enters the drying compartment 12 via the inlet 16. Air is continuously exhausted from the drying compartment 12 via the exhaust passage 18 to avoid saturation. Preferably the exhaust passage 18 includes a length of tube or hose (not shown) directing the exhaust outside a building, room or the like. The exhaust air expels humidity and excess heat from the drying compartment 12, thereby preventing the air from becoming saturated with water vapor and impeding dryer effectiveness, and also preventing overheating and the possibility of damage to the clothes and dryer and/or the beginning of a fire. The air flow detecting system 20 is located proximal to the exhaust passage 18, and detects the air flow through the exhaust passage 18. The air flow detecting system 20 communicates with the processor 22, and the processor 22 acts to control the dryer system 10 in response to signals received from the air flow detecting system 20.

Figure 2:
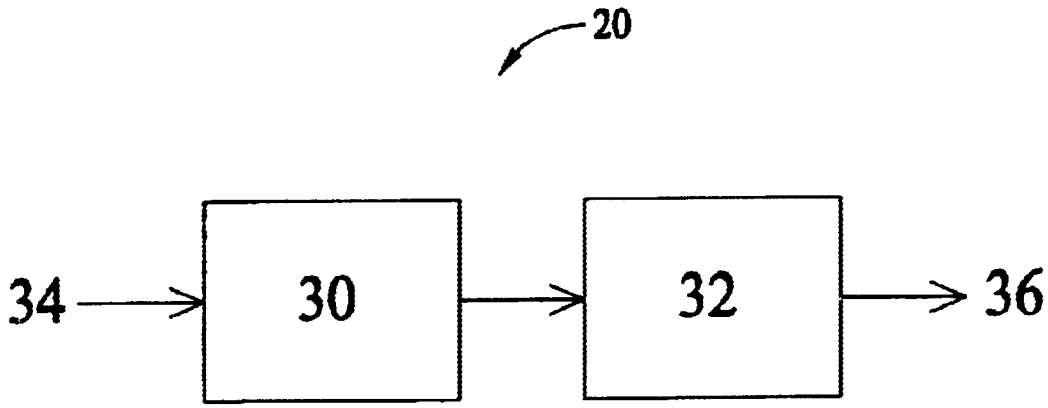
FIG. 2 illustrates block diagram of an air flow detecting system formed in accordance with an embodiment of the present invention.

FIG. 2 is a block diagram illustrating the general operation of certain embodiments of the air flow detecting apparatus 20. The air flow detecting apparatus 20 comprises the detector 30 and the signal generator 32. The detector 30 is responsive to the air flow 34. The signal generator 32 provides an electrical signal 36 responsive to the detector 30. For example, the detector 30 may be a mechanical element whose position and/or motion is responsive to the air flow 34. For instance, the detector 30 may comprise a fan that rotates responsive to the rate of air flow 34 or vanes whose position is altered responsive to the rate of air flow 34. The signal generator 32 may be a sensor which produces the electrical signal 36 based on the position and/or motion of the detector 30. The electrical signal 36 may vary in phase, frequency, voltage, or current based on the rate of air flow 34 detected by the detector 30. Further, the electrical signal 36 may be intermittently turned on and off directly proportional to the rate of air flow 34. Preferably, the detector 30 directly monitors the air flow 34 through the exhaust passage 18, as opposed to indirectly, as would be the case with a pressure indicator such as a diaphragm. While the detector 30 may be a mechanism, it may alternatively be a non-moving sensor such as a pitot tube or a Doppler effect device. A1

Figure 3:
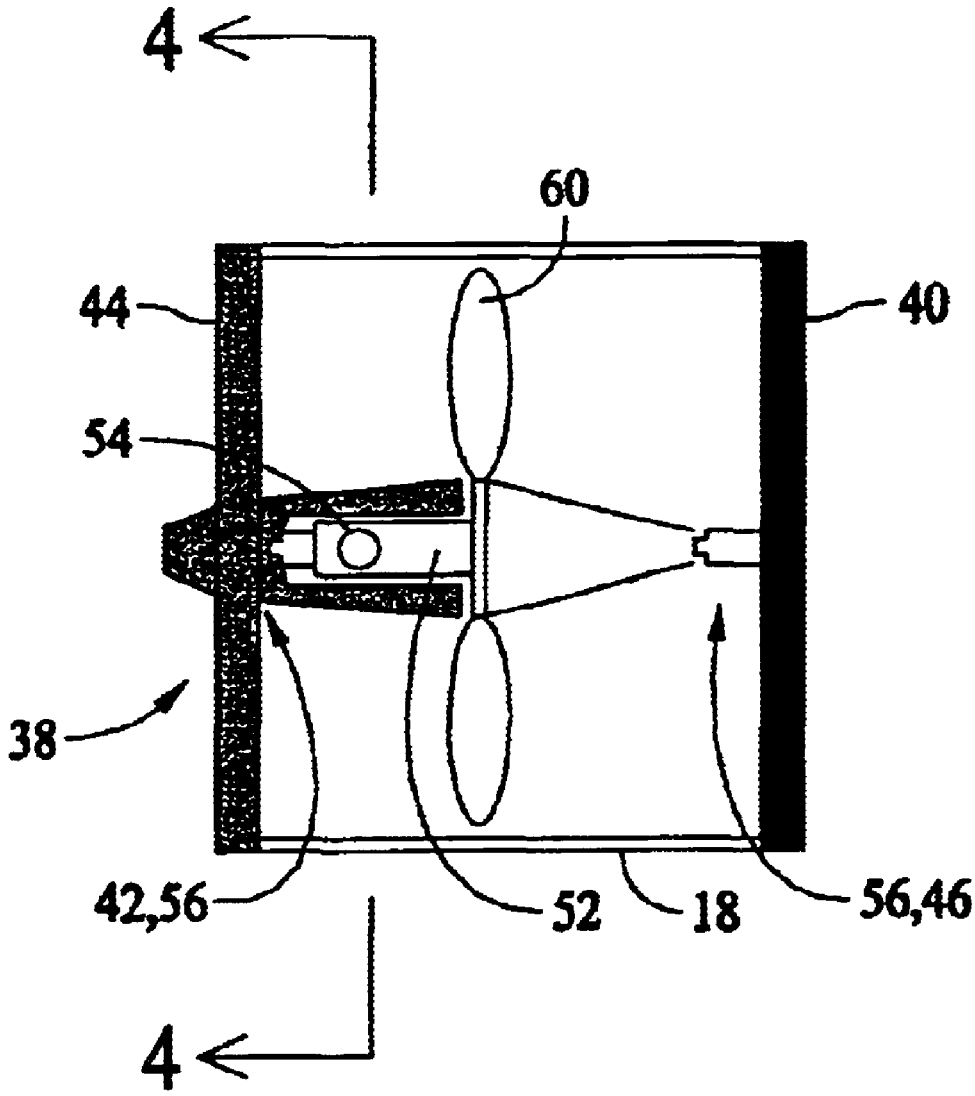
FIG. 3 illustrates a side view of an air flow detecting system formed in accordance with an embodiment of the present invention.
Figure 4:
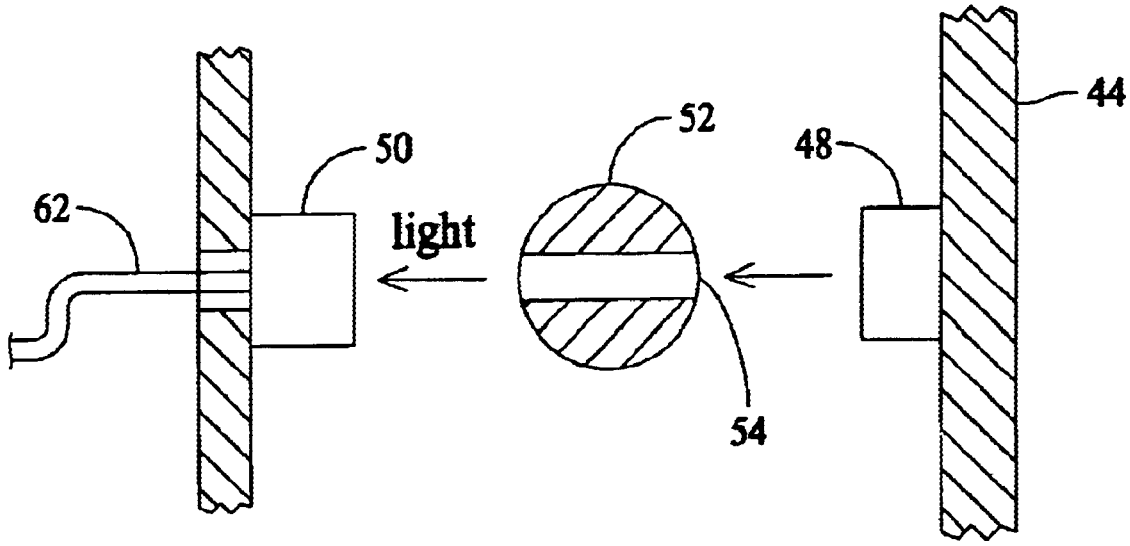
FIG. 4 illustrates a sectional view taken along section line 4—4 of FIG. 3 of an air flow detecting system formed in accordance with an embodiment of the present invention.

FIGS. 3 and 4 illustrate an embodiment of an air flow detecting apparatus 38. The air flow detecting apparatus 38 is mounted proximal to the exhaust passage 18. The air flow detecting apparatus 38 comprises a first housing 40, a second housing 44, a light emitting source 48 (FIG. 4), a light receiver 50, a shaft 52, a fan 60, and a cable 62. The first housing 40 is mounted to the exhaust passage 18 and comprises a bearing 46 configured to receive and support one end of the shaft 52. Similarly, the second housing 44 is mounted to the exhaust passage 18 and comprises a bearing 42 configured to receive and support one end of the shaft 52. Preferably, the first housing 40 and the second housing 44 comprise ribs and/or notches (not shown) configured to mate with ribs and/or notches (not shown) in the exhaust passage 18 to facilitate easy mounting with a minimum of external fasteners. Additionally or alternatively, the first housing 40 and second housing 44 may form part of the exhaust passage 18.

The light emitting source 48 and the light receiver 50 are mounted proximal to the second housing 44. For example, the light emitting source 48 may be a light emitting diode and the light receiver 50 may be a standard sensor readily available as an off-the-shelf part. The light emitting source 48 and the light receiver 50 are aligned such that light from the light emitting source 48 shines on the light receiver 50.

The fan 60 is mounted to the shaft 52. Air flow through the exhaust passage 18 causes the fan 60 and the shaft 52 to rotate. The greater the rate of air flow through the exhaust passage 18, the faster the shaft 52 will rotate. The shaft 52 comprises a hole 54 and bearing portions 56. The bearing portions 56 are located at the ends of the shaft 52 and are configured to be accepted by the bearings 42, 46 of the first housing 40 and the second housing 44. Preferably, the bearing portions 56 are cone shaped, and the bearings 42, 46 feature cone shaped bores configured to accept the bearing portions 56 while providing a slight clearance. The hole 54 is bored perpendicular to and through the longitudinal axis of the shaft 52, and is located along the length of the shaft 52 such that the hole 54 may be aligned with the light emitting source 48 and the light receiver 50. The shaft 52 is positioned such that it blocks the path of the light from the light emitting source 48 to the light receiver 50.

However, the hole 54 permits light from the light emitting source 48 through when the shaft 52 has rotated to a position where the hole 54 is aligned with the light emitting source 48 and the light receiver 50. As the shaft 52 rotates, the hole 54 will allow light through twice per revolution. Consequently, if light is continuously sent from the light emitting source 48, the light will be received twice per rotation of the shaft 52 by the light receiver 50. The light receiver 50 then generates a signal responsive to the intermittent reception of light which is sent to the processor 22 via the cable 62. Thus, the air flow in the exhaust passage 18 is converted to a mechanical rotation of the shaft 52 and fan 60, which is converted to an electrical signal via the cooperation of the light emitting source 48, light receiver 50, and hole 54. The electrical signal is then sent to the processor 22 which controls the dryer system 10. Alternatively to the above described mounting, the light emitting source 48 and light receiver 50 could be mounted to a common circuit board (not shown), and linked to the shaft 52 with fiber optic cable (not shown).

Figure 5:
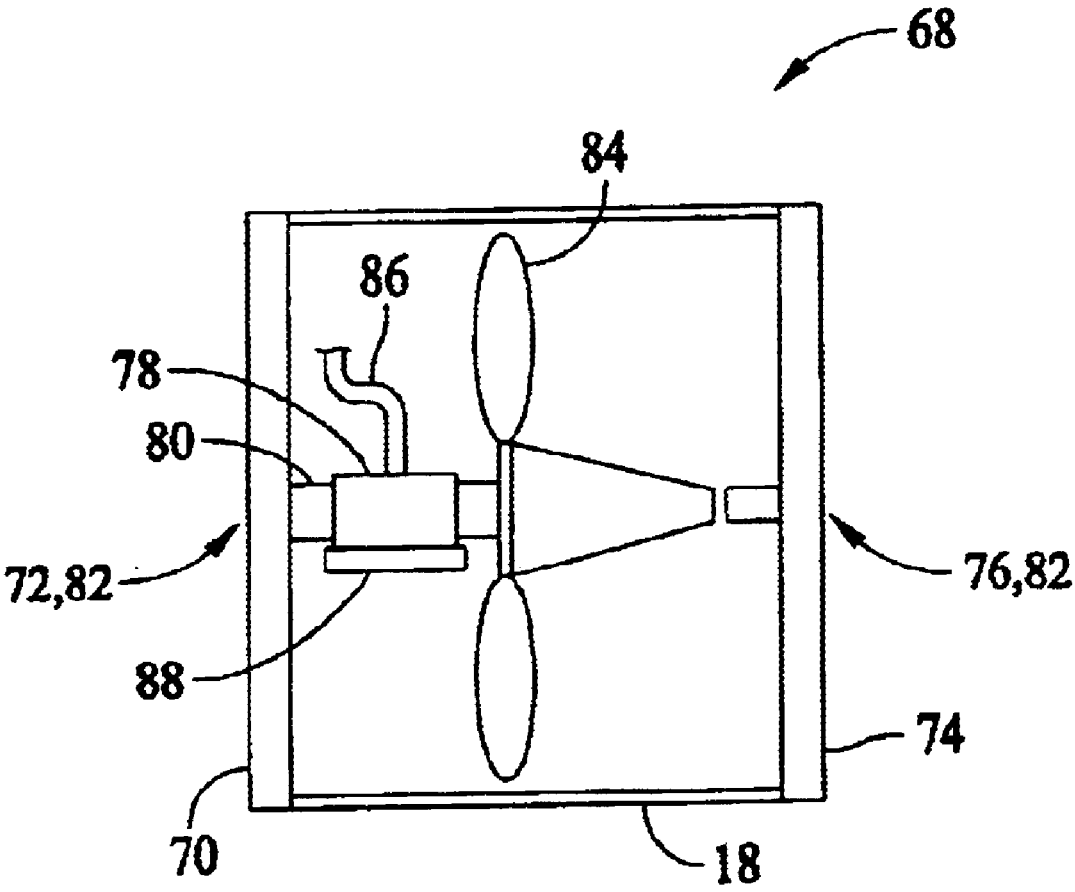
FIG. 5 illustrates a side view of an air flow detecting system formed in accordance with an additional alternative embodiment of the present invention.

FIG. 5 illustrates another embodiment of an air flow detecting apparatus 68 that is similar in some respects to the embodiment illustrated in FIGS. 3 and 4 and different in others. The air flow detecting apparatus 68 is mounted proximal to the exhaust passage 18. The air flow detecting apparatus 68 comprises a first housing 70, a second housing 74, a generator 78, a shaft 80, a fan 84, a cable 86, and a mounting strut 88. The first housing 70 is mounted to the exhaust passage 18 and comprises bearings 72 configured to receive and support one end of the shaft 80. Similarly, the second housing 74 is mounted to the exhaust passage 18 and comprises a bearing 76 configured to receive and support one end of the shaft 80. Preferably, the first housing 70 and the second housing 74 comprise ribs and/or notches (not shown) configured to mate with ribs and/or notches (not shown) in the exhaust passage 18 to facilitate easy mounting with a minimum of external fasteners. Alternatively or additionally, the first housing 70 and the second housing 74 may form part of the exhaust passage 18.

The generator 78 is mounted to the mounting strut 88. The mounting strut 88 is mounted to the exhaust passage 18. Alternatively, the mounting strut 88 may be mounted to either the first housing 70 or the second housing 74. The generator 78 may be, for example, a standard DC generator. Other devices that could be used for the generator 78 include an AC generator and dynamo. The generator 78 is mounted such that the shaft 80 passes through the generator 78, and the generator 78 generates an electrical signal responsive to the rotation of the shaft 80.

The fan 84 is mounted to the shaft 80. Air flow through the exhaust passage 18 causes the fan 84 and the shaft 80 to rotate. The greater the rate of air flow through the exhaust passage 18, the faster the shaft 80 will rotate. The shaft 80 comprises bearing portions 82. The bearing portions 82 are located at the ends of the shaft 80 and are configured to be accepted by the bearings 72, 76 of the first housing 70 and the second housing 74. Preferably, the bearing portions 82 are cone shaped, and the bearings 72, 76 feature cone shaped bores configured to accept the bearing portions 82 while providing a slight clearance. The shaft 80 is positioned such that it passes through the generator 78. Consequently, the generator 78 will produce an electrical signal responsive to the rotation of the shaft 80. Thus, the air flow in the exhaust passage 18 is converted to a mechanical rotation of the shaft 80 and fan 84, which is converted to an electrical signal via the cooperation of the generator 78. The electrical signal is then sent to the processor 22 which controls the dryer system 10.

Figure 6:
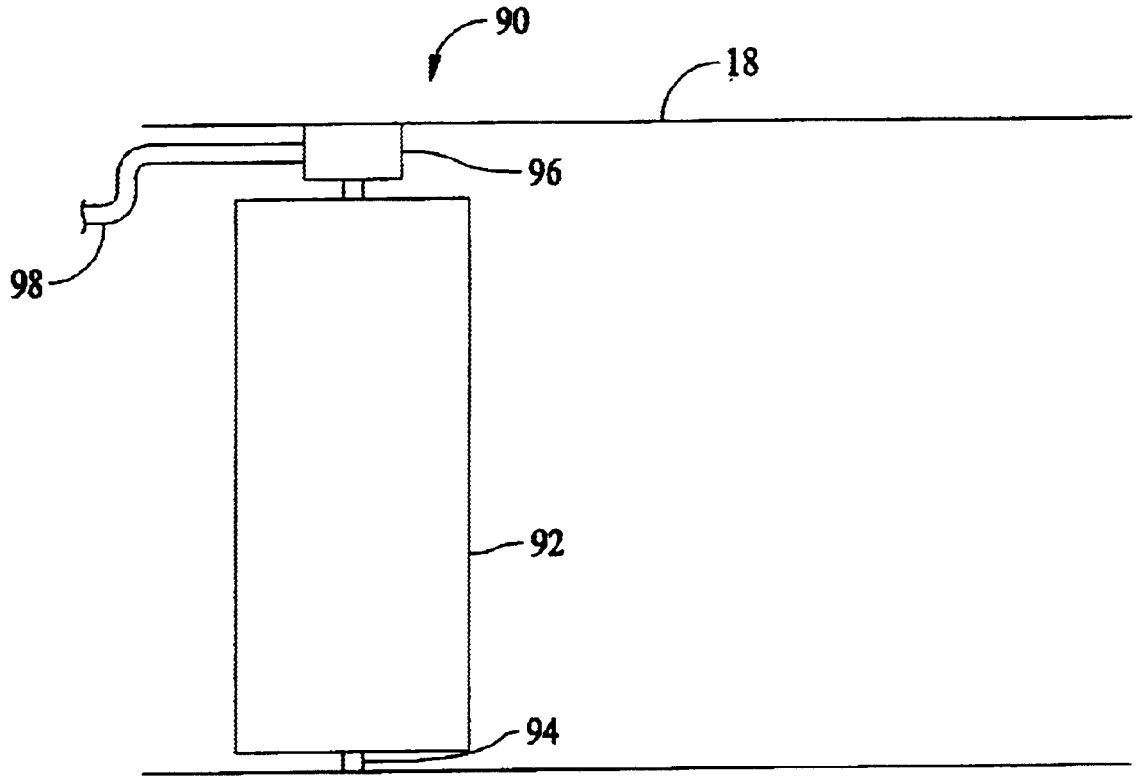
FIG. 6 illustrates a side view of an air flow detecting system formed in accordance with a second additional alternative embodiment of the present invention.

FIG. 6 illustrates another embodiment of the air flow detecting apparatus 90. In this embodiment, the air flow detecting apparatus 90 comprises vanes 92, shafts 94, a sensor 96, and a cable 98. The vanes 92 are mounted to the shafts 94, and the shafts 94 are mounted to the exhaust passage 18. The vanes 92 are biased to shut in the absence of air flow through the exhaust passage 18. Air flow through the exhaust passage 18 acts to open the vanes 92, or cause them to pivot on or with the shafts 94. The greater the rate of air flow, the more the vanes 92 will pivot toward a fully open position. At least one sensor 96 is mounted proximal to at least one shaft 94 to sense the angle to which the vanes 92 are pivoted open. The sensor 96 then sends an electrical signal over cable 98 to the processor 22 having a voltage representative of an amount to which the vanes 92 have pivoted open. Thus, the rate of air flow in the exhaust passage 18 is converted to a mechanical position of the vane 92, which is converted to an electrical signal via the sensor 96. The electrical signal is then sent to the processor 22, and based thereon, the processor 22 controls the dryer system 10.

Figure 7:
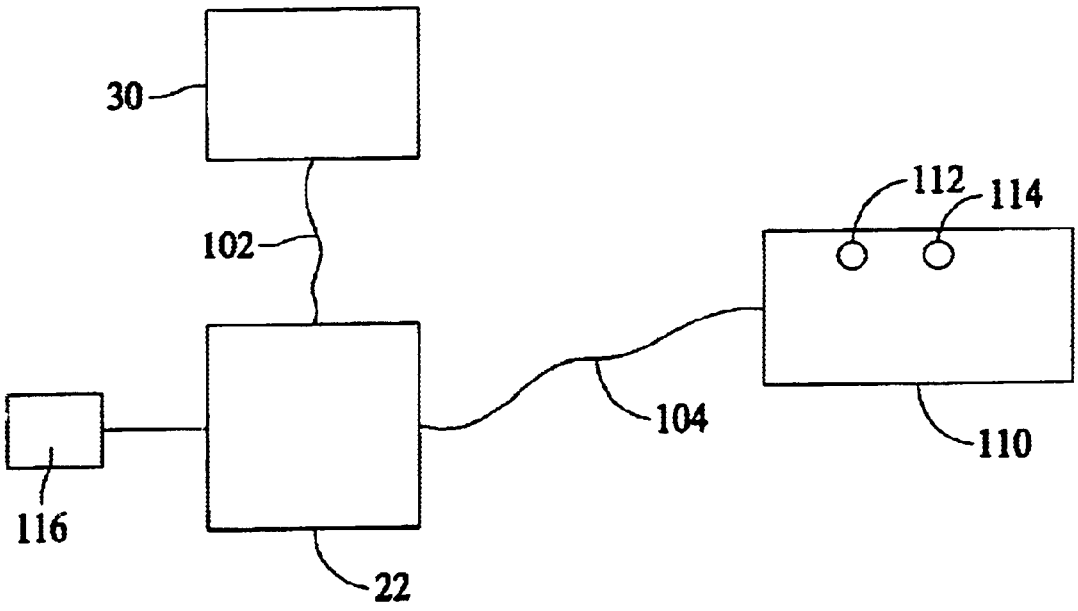
FIG. 7 illustrates the operation of an air flow detecting system with a processor formed in accordance with an embodiment of the present invention.

FIG. 7 illustrates the operation of the processor 22 in the dryer system 10. As explained above, the detector 30 monitors the rate of air flow 34 through the exhaust passage 18. The signal generator 32, in response to the detector 30, produces an electrical signal corresponding to the rate of air flow 34. The electrical signal is then sent to the processor 22 via the signal cable 102. Using the electrical signal as an input, the processor 22 produces a control signal based on the electrical signal. The processor 22 may be, for example, a CPU, a microprocessor, a printed circuit board, or other electrical circuitry. The control signal is then sent to another part of the dryer system 10 via the control cable 104 to control the operation of the dryer system 10.

One way the processor 22 may act to control operation of the dryer system 10 is by turning individual components and/or all of the dryer system 10 off in response to the rate of air flow. Additionally or alternatively, the processor 22 may control the operation of warning lights, alarms, or other indicators to alert the operator of the dryer system of a potentially dangerous condition. For example, the dryer system 10 comprises a control panel 110. The control panel 110 in turn comprises a warning light 112 and an on/off light 114. When the air flow as measured by the air flow detecting apparatus 20 drops below a first predetermined rate corresponding to less effective drying but still sufficient so that the dryer system 10 is not operating in a dangerous condition, the processor 22 sends a control signal to the control panel 110 turning the warning light 112 on. This indicates to the operator that the exhaust passage 18 should be checked, but still allows the dryer system 10 to operate. Thus, the dryer system 10 can be returned to a more effective drying operation sooner than if no indication were given. Further, any problem with the rate of air flow, such as, for example, a blocked lint trap, may be addressed before a dangerous condition arises. If the air flow further reduces below a second predetermined level to result in a dangerous condition, the processor 22 can send a control signal causing, for example, the heater 14 or the entire dryer system 10 to be turned off. Additionally, the processor 22 can send a control signal to the control panel 110 causing the on/off light 114 to be turned on, indicating to the operator that the dryer system 10 has stopped drying due to a dangerous lack of air flow through the exhaust passage 18.

Alternatively or additionally to turning the dryer system 10 off, the processor 22 may act to modulate one or a plurality of operating parameters. For example, the processor 22 may operate to optimize parameters such as drum rotational speed and temperature based on air flow.

Another example of how the processor 22 may control the operation of the dryer system 10 occurs at the start-up of the dryer system 10. When the dryer system 10 is initially started, the heater 14 may be left off. Then, once air flow through the exhaust passage 18 is detected, the processor 22 can send a control signal starting the heater 14. Thus, if the air flow is blocked, the heater 14 will not even be turned in the first place and the operator will immediately be alerted to the condition, instead of having to wait for a dangerous temperature level to be reached, as with current conventional dryers. This results in increased safety as well as providing the operator with a quicker notification of a problem with the operation of the dryer system 10.

The processor 22 may also work in cooperation with devices sensing operating parameters other than air flow. For example, the processor 22 may use signals from the drum sensor 24 monitoring the rotation of the drying compartment 12 in addition to those from the detecting system 20. Thus, if the drum stops rotating, the processor 22 may act responsively by, for example, turning on a warning light and/or shutting off all or part of the dryer system 10. The processor 22 may also receive additional signals from a temperature sensor 116 monitoring temperature inside the drying compartment 12. The processor 22 can then control the dryer system 10 based on multiple parameters of the operation of the dryer system 10 in addition to air flow, as well as the interaction of multiple parameters.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A dryer system comprising:

a drying compartment for holding articles to be dried;

a heater providing heat to said drying compartment to assist in drying the articles;

an exhaust passage discharging air from said drying compartment at an air flow rate;

a detecting system monitoring said air flow rate through said exhaust passage; and a processor controlling operation of said dryer system based on an output of said detecting system identifying said air flow rate.

2. The dryer system of claim 1 further comprising a mechanical element communicating with said exhaust passage and moving in response to said air flow rate, and a sensor detecting a position of said mechanical element moved by said air flow rate through said exhaust passage.

3. The dryer system of claim 1 further comprising:

a shaft;

a fan mounted on said shaft, said fan and shaft rotating at a speed proportional to said air flow rate through said exhaust passage; and a sensor sensing rotation of said shaft and outputting a signal identifying said air flow rate.

4. The dryer system of claim 1 further comprising:

a shaft having a hole therethrough;

a fan mounted on said shaft, said fan rotating said shaft in response to said air flow through said exhaust passage; and a sensor sensing rotation of said shaft, said sensor comprising a light emitting source and a light receiver configured so that light from said light emitting source is directed through said hole of said shaft at said light receiver, said shaft intermittently interrupting light passage through said hole as said shaft rotates.

5. The dryer system of claim 1 further comprising an air flow sensor providing an intermittent signal to said processor, wherein a timing and duration of each interruption of said intermittent signal varies based on a rate of said air flow through said exhaust passage.

6. The dryer system of claim 1 wherein said detecting system generates an air flow signal directly proportional to a rate of air flow through said exhaust passage.

7. The dryer system of claim 1, wherein said detecting system directly monitors a rate of air flow through said exhaust passage.

8. The dryer system of claim 1, wherein said detecting system monitors said air flow rate through said exhaust passage independent of a pressure within said exhaust passage.

9. The dryer system of claim 1, wherein said processor operates to turn at least part of said dryer system off when said air flow rate through said exhaust passage is less than a predetermined rate.

10. The dryer system of claim 1, wherein said processor operates to modulate one or a plurality of operating parameters in response to said air flow rate.

11. The dryer system of claim 1, wherein said processor operates to provide a perceptible warning indication when said air flow rate through said exhaust passage is less than a first predetermined rate, and said processor operates to turn at least part of said dryer system off when said air flow rate through said exhaust passage is less than a second predetermined rate.

12. An air flow detecting apparatus for monitoring air flow in a dryer system, said dryer system having an exhaust passage through which air from a drying compartment flows, said air flow detecting apparatus comprising:

a detector directly monitoring a rate at which air from the drying compartment travels through an exhaust passage; and a signal generator responsive to said detector for generating an electrical signal, for which at least one of phase, frequency, voltage, or current varies over a continuous range based on a measured air flow rate.

13. The air flow detecting apparatus of claim 12 further comprising a mechanical element communicating with said exhaust passage and moving in response to said air flow rate, and a sensor detecting a position of said mechanical element moved by said air flow rate through said exhaust passage.

14. The air flow detecting apparatus of claim 12 further comprising:

a shaft;

a fan mounted on said shaft, said fan and shaft rotating at a speed proportional to said air flow rate through said exhaust passage; and a sensor sensing rotation of said shaft and outputting a signal identifying said air flow rate.

15. The air flow detecting apparatus of claim 12 further comprising:

a shaft having a hole therethrough;

a fan mounted on said shaft, said fan rotating said shaft in response to said air flow through said exhaust passage; and a sensor sensing rotation of said shaft, said sensor comprising a light emitting source and a light receiver configured so that light from said light emitting source is directed through said hole of said shaft at said light receiver, said shaft intermittently interrupting light passage through said hole as said shaft rotates.

16. The air flow detecting apparatus of claim 12, wherein said detecting apparatus generates an air flow signal directly proportional to a rate of air flow through said exhaust passage.

17. The air flow detecting apparatus of claim 12 further comprising an air flow sensor providing an intermittent signal to said processor, wherein a timing and duration of each interruption of said intermittent signal varies based on a rate of said air flow through said exhaust passage.

* * * * *